United States Patent [19]

Blandford

[11] Patent Number: 4,558,973

[45] Date of Patent: Dec. 17, 1985

[54] SUBSEA WELLHEAD PROTECTOR

[75] Inventor: Joseph W. Blandford, Houston, Tex.

[73] Assignee: Seahorse Equipment Corporation, Houston, Tex.

[21] Appl. No.: 622,990

[22] Filed: Jun. 21, 1984

[51] Int. Cl.[4] ..... E02B 17/02; E02D 31/00

[52] U.S. Cl. ..... 405/216; 405/211; 405/227; 166/356

[58] Field of Search ..... 405/195, 203, 204, 208, 405/211, 216, 217, 224, 227; 166/356, 364

[56] References Cited

U.S. PATENT DOCUMENTS

| | | | |
|---|---|---|---|
| 3,271,963 | 9/1966 | Blenkarn | 405/211 |
| 3,389,562 | 6/1968 | Mott et al. | 405/227 X |
| 3,496,728 | 2/1970 | Slack | 405/211 |
| 3,605,413 | 9/1971 | Morgan | 405/211 |
| 3,793,840 | 2/1974 | Mott et al. | 405/211 |
| 4,273,472 | 6/1981 | Piazza et al. | 405/211 |
| 4,283,159 | 8/1981 | Johnson et al. | 405/211 X |
| 4,445,806 | 5/1984 | Crain | 405/216 |

*Primary Examiner*—Dennis L. Taylor
*Assistant Examiner*—Nancy J. Stodola
*Attorney, Agent, or Firm*—Gunn, Lee & Jackson

[57] ABSTRACT

For use with a subsea well incorporating an external conductor pipe extending upwardly above the seabed, a protector apparatus is set forth. In the preferred and illustrated embodiment, the preferred embodiment describes a longitudinally split, flange equipped, bolt joined elongate conductor clamp supported on a frame at the bottom thereof and having a plurality of appended upstanding braces. The bottom frame is adapted to be rested on a seabed and held in place by a number of anchors driven into the seabed at corners. This apparatus is selectively installed after completion of a well wherein the conductor pipe extends above the bottom, and the apparatus is subsequently removed after protecting the pipe after drilling but before installation of a platform.

11 Claims, 8 Drawing Figures

FIG. 1
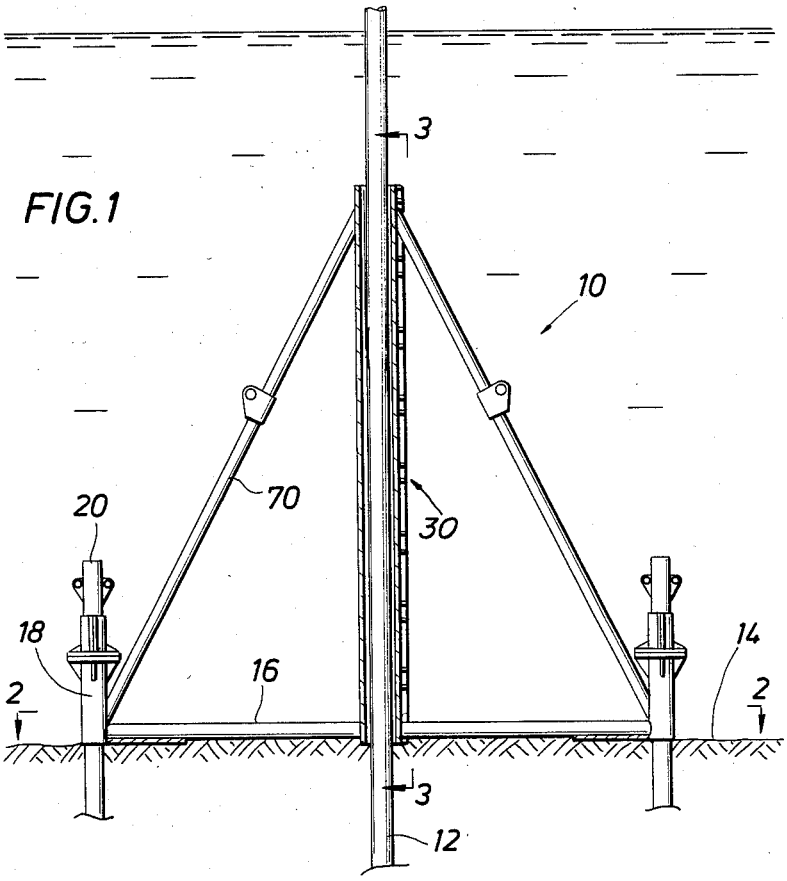
FIG. 3
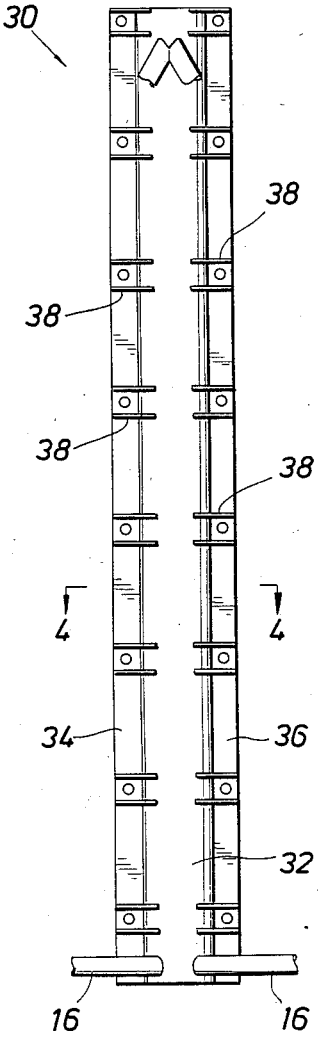
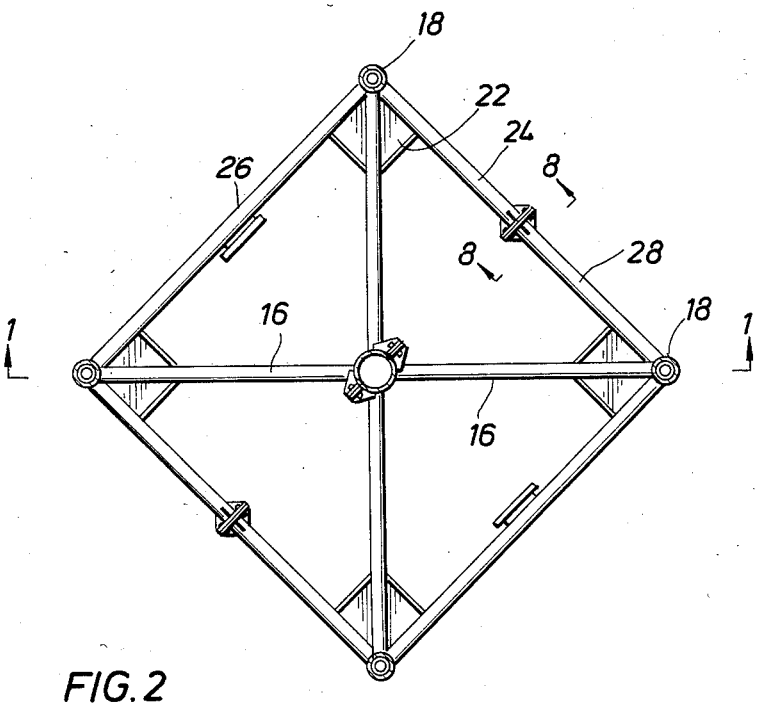
FIG. 2
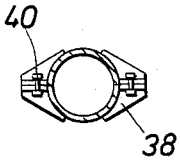
FIG. 4

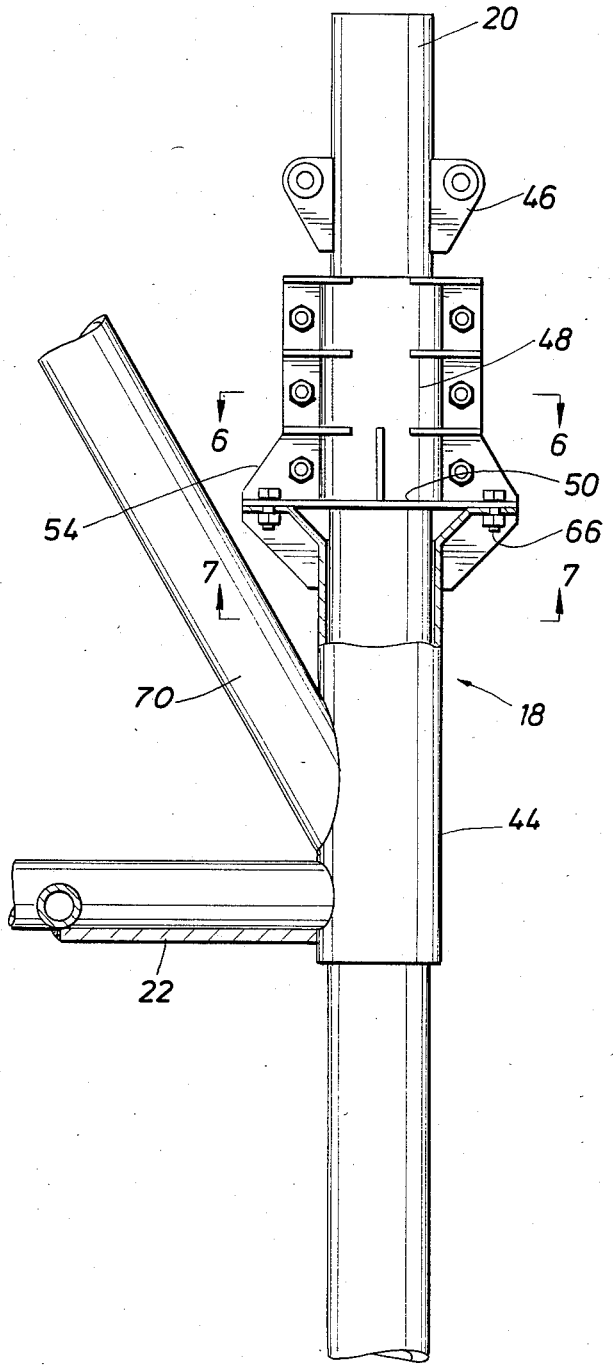
FIG. 5
FIG. 6
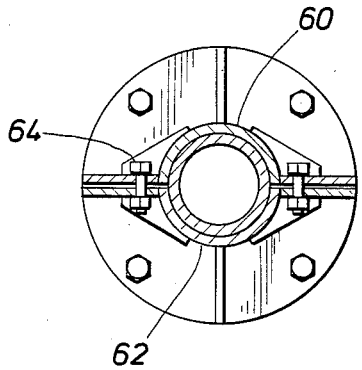
FIG. 7
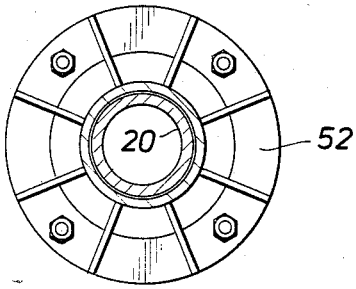
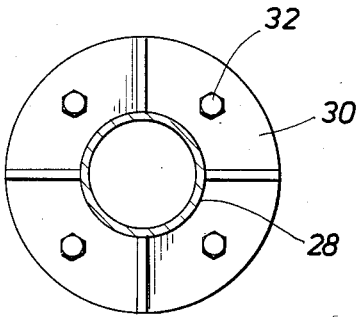
FIG. 8

SUBSEA WELLHEAD PROTECTOR

BACKGROUND OF THE DISCLOSURE

This apparatus is protective equipment to be used with a completed well. This particularly finds application in wells completed at offshore locations. Assume for explanatory purposes that a well is drilled from a jackup drilling rig or perhaps a semi-submersible drilling rig. Assume that the well is drilling in 50 feet of water. The vessel which supports the drilling rig remains on location during the drilling process. After the drilling process has been completed, the drilling vessel is then moved to another location to drill another well. At the time that the vessel is on location, the well may be completed, and production verified so that a production platform can be fabricated on shore to be towed to location later.

Assume that the well is sufficiently productive that it justifies the installation of some type of production platform. In addition, well production equipment can be devised and assembled onshore and subsequently moved to the site of the well for installation onto the production platform at the wellsite. Without regard to the particular shape or form of the equipment or platform to be subsequently installed, it takes months, typically about one year or so, to get equipment constructed onshore and moved to the offshore location. If the water is 50 feet deep, this might require fabrication of a production platform which stands about 125 feet tall and which weighs several hundred tons. Clearly, such equipment cannot be fabricated quickly and it must be fabricated carefully, typically tailored to the precise circumstances of the particular well so that it can be towed to location and installed. Sometimes, between 12 and 18 months will pass between the completion of the well and the installation of the production platform.

It is not economically feasible to maintain the drilling rig on location until the platform has been installed. Rather, the drilling rig is moved to another well site to initiate drilling at that location. This requires that the drilling rig leave the scene and leave the well. The departure of the drilling equipment marks the end of drilling activities at the well. It is expedient for the drilling equipment, including the vessel, to be moved to another drilling site immediately after well completion so that it can economically be used in drilling another well. Preferably, the well is left with suitable casing in the hole extending to some selected depth. Production tubing is also typically installed. A conductor pipe typically surrounds the casing and extends into the bottom. For instance, the conductor pipe might be 30 inch diameter pipe and have a length of about 200 or 300 feet. The conductor pipe is typically positioned so that the top of the conductor pipe extends a distance of between 15 and 45 feet above the still water line.

The well is then shut in by installing suitable closed valves or plugs in the well. The drilling vessel departs the area and hence leaves the well substantially unprotected wherein the casing located in the larger conductor pipe is exposed to some degree of risk until the production platform can be fabricated and installed. The conductor pipe may be unsupported for a length of between 30 and 125 feet inclusive, or even longer.

This equipment is protective equipment for the otherwise free-standing conductor pipe which visably extends from the mud line to a predetermined point above the water line. Assume that the conductor pipe protrudes from the bottom, perhaps standing 30 feet above the water line. It is vulnerable to damage from navigating ships in the area, and particularly can be damaged by extreme lateral loads caused by winter storms and summer hurricanes when left unprotected. The present apparatus is a protective device which fastens temporarily or permanently onto the conductor pipe. The conductor pipe is typically in the range of about 26 to about 30 inches in diameter and has wall thickness of about one inch. It is susceptible to bending and damage when left unprotected. Moreover, the conductor pipe is encased and secured by the present apparatus.

This protective apparatus incorporates a steel tubular split vertical clamp, adapted to securely clamp to the protruding conductor pipe. The conductor clamp is divided into two similar pieces, split along the length thereof, and the two pieces have edge located flange plates which are joined by suitable nuts and bolts. Moreover, the conductor clamp at the lower end is connected with and braced to a rectangular frame suitably fastened to the seabed or to a supporting substructure. It is held in place by piles which are driven through the corners. Moreover, the upper end of the conductor clamp is laterally supported by diagonally positioned braces, the braces extending from the top of the clamp to the pile anchor sleeves at the corner and on the bottom. The device is split into two halves along the diameter of the device and the two halves are bolted together surrounding the conductor pipe.

BRIEF DESCRIPTION OF THE DRAWING

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a side view showing the protective apparatus of this disclosure installed around a conductor pipe protruding from the bottom of a body of water;

FIG. 2 is a sectional view along the line 2—2 showing the rectangular base frame of the apparatus which anchors the apparatus at the bottom;

FIG. 3 is a sectional view along the line 3—3 in FIG. 1 showing details of construction of the vertically positioned conductor clamp of this disclosure;

FIG. 4 is a sectional view along the line 4—4 of FIG. 3 showing construction of the conductor clamp in mating halves which fasten together;

FIG. 5 is an enlarged partial side view of one corner of the frame depicting a steel tubular pile that is driven through a pile sleeve at the corner to anchor the apparatus temporarily or permanently in position;

FIG. 6 is a sectional view along the line 6—6 of FIG. 5 showing details of construction of a pile clamp which fastens around the piling;

FIG. 7 is a sectional view along the line 7—7 of FIG. 5 showing details of construction of the pile sleeve guide mechanism; and FIG. 8 is a sectional view along the line 8—8 of FIG. 2 showing a means for joining adjacent halves together to assemble the apparatus.

DETAILED DESCRIPTION OF THE PREFERRED EMBODIMENT

Attention is directed to FIG. 1 of the drawings. In FIG. 1 the protection apparatus 10 of this disclosure is shown installed at a well. Assume that the well has been completed and is evidenced primarily by conductor pipe 12 extending from the bottom 14. Assume further that the conductor pipe is typically quite long, perhaps being a few hundred feet in length. It is typically fabricated of pipe up to about 30 inches in diameter. Assume further that it stands about 20 feet or more above the water line. The conductor pipe 12 is more or less perpendicular to the bottom. It may enclose various and sundry safety or cutoff valves and the like. Primarily, the conductor pipe 12 protrudes vertically above the water and is normally unsupported and is exposed to damage during the interval after the vessel supporting the drilling rig departs the area, and is best protected by the protective apparatus 10 until a permanent production platform can be installed at the wellhead.

The apparatus 10 is therefore a safety device, temporarily installed. It is installed on the conductor pipe 12 for an interval. It is divided into two halves as shown in FIG. 2. In the assembled state, it includes four identical radial frame members 16. The frame members 16 are horizontal, and extend radially outwardly from the center of the equipment to the four corners. At each corner, there is a piling sleeve 18. They are preferably identical. A suitable piling 20 is driven through each corner and extends into the bottom. The piling is sufficiently long to be driven sufficiently deep into the sea bottom 14 to enable each corner of the structure to be anchored. The piling 20 is installed to fasten and later removed to free the safety apparatus 10. As shown in FIG. 2, the piling sleeve 18 is adjacent to a typical angle reinforced mudmat 22 to prevent the device 10 from sinking into the soft seabed before adequate support piles 20 are installed. The frame member 26 is full length, extending from corner to corner of the structure as shown in FIG. 2. The frame member 24 is short, and terminates at a flange fastener. The frame member 24 aligns with a similar frame member 28. The two frame members are joined together by the flanged structure shown in FIG. 8. There, it will be observed that the flange 30 is on the end of the tubular bracing member 28. The flange 30 aligns with a similar flange on the frame member 24. The two flanges are positioned adjacent to one another and are fastened together by suitable nuts and bolts 32. The two flange plates assemble the frame members 24 and 28 so that they collectively have a length approximately equal to the length of the frame member 26.

One advantage of the flange connection between the members 24 and 28 is to enable the structure to be broken into two similar halves for ease of shipping, ease of installation, and so the structure can be componentized. This also enables it to protect multiple wells at a single offshore location. In the case of multiple well protection, it is necessary to add a center component to the system shaped as an E to bolt or fasten between halves.

When viewed from above, the frame members define a rectangle which is centered about the conductor pipe 12. The rectangle is constructed with four corners to position four piling sleeves at the respective corners. Thus, the assembled equipment is a rectangle having four sides which are preferably approximately equal, thereby defining a square. The four corners are anchored by suitable pilings 20 which are driven through the four corners which temporarily or permanently stake the apparatus to the bottom. This holds the equipment in location for the time that it is installed. Moreover, it is held stable at the anchored location. The four sides are preferably rectangular, and can even be square so that the sides 24 and 28 are fastened together. The device divides into two halves to enable it to be easily positioned about the conductor pipe 12.

The structure incorporates the radially positioned frame members 16. They extend to the four corners and hence are connected to the four piling sleeves 18. The radially positioned frame members 16 fasten at the lower ends of the conductor clamp 30. The conductor clamp 30 is shown in better detail in FIG. 3. There, the conductor clamp comprises a hollow, elongated, split structure also shown in sectional view in FIG. 4. It is formed of identical halves. One half is identified by the numeral 32 and comprises a semi-circular sleeve member. It is supported at the bottom by the radial frame members 16. These frame members hold the conductor clamp in an upright position. Moreover, the conductor clamp incorporates edge located flanges 34 and 36. The flanges 34 and 36 are positioned adjacent to mating flange plates on the symmetrical half so that the conductor clamp can be fabricated and joined together. The flange plates 34 and 36 are stiffened by suitable reinforcing gussets 38. The reinforcing gussets 38 are incorporated for the purpose of stiffening the connecting flanges 34 and 36 so that they will not bend. At suitable locations, the flange plates 34 and 36 are drilled with matching sets of holes to enable fasteners such as nuts and bolts to assemble the two halves into the conductor clamp. In FIG. 4, nuts and bolts are identified at 40 for fastening the two halves together. This assembles the conductor clamp.

It will be observed in FIG. 1 that the conductor clamp is designed so that it fits snugly around the conductor pipe. When the nuts and bolts are used to assemble the two halves, they are pulled tightly together and bolted around the conductor pipe. Moreover, this conductor clamp extends slightly below the radial frame members 16. This enables the lower end of the device to embed into the mud. The upper end typically stands shorter than the conductor pipe, and reduces the unbraced length of the conductor pipe to enable it to carry greater lateral loads than if standing alone. The conductor pipe is thus stiffened and reinforced by the conductor clamp 30. The conductor pipe is firmly held within the conductor clamp 30. As an example, assume that the conductor pipe has a 30 inch OD and that the conductor clamp 30 has a 30 inch ID. It is fastened around the conductor pipe and made snug against the pipe by tightening the nuts and bolts along the flanges. This enables assembly of the sleeve around the conductor pipe in the field. The conductor clamp may be loosened and stabbed over the wall conductor, or it may be disassembled and installed onto the well conductor pipe in two pieces. If the device is installed in two pieces or halves, one half is first positioned adjacent to the conductor pipe 12 and set on the seabed 14, and the second half is thereafter positioned on the opposite side. Once they are in position, suitable nuts and bolts are used to fasten the two halves together, thereby securing the conductor clamp around the conductor pipe and holding it securely in position. The conductor clamp 30 is sized so that it fits snugly around the conductor pipe 12 so that the two are fastened together in concentric relationship, thereby anchoring the device. This aids and assists in stability of the safety device fastened around the conductor pipe 12.

Attention is directed momentarily to FIG. 5 of the drawings where the piling sleeve 18 is shown in greater detail. It comprises an upstanding sleeve 44 which is located at each corner of the rectangular frame as shown in FIG. 2. The steel mudmats and support angles 22 are affixed to the sleeve 44 and lower bracing members 24 and 26 (FIG. 2). The sleeve 44 is approximately perpendicular to the plane. The four corners of the frame are thus all equipped with similar sleeves, and they are preferably parallel to one another so that pilings 20 can be driven through them in parallel fashion. Each piling 20 shown in FIG. 5 has a set of two protruding lifting eyes at 46 to enable the piles to be removed at a later date. The lifting eyes are located at a distance from the upper end of the piling so as not to interfere with the pile driving apparatus. The piling 20 is typically driven by suitable means into the soil below the sleeve 44 so that it is anchored.

The piling is first driven through the sleeve 44. After that, it is fastened. It is held in place relative to the equipment by means of a fastener better shown in FIGS. 6 and 7. Briefly, the sectional view of FIG. 7 is through a flanged pile clamp 48 secured above the sleeve 44. The flanged pile clamp 48 supports a protruding flange plate 50 shown in FIG. 5. On the bottom side, it fastens to a matching flange plate 52 which is attached to the upper end of the sleeve 44. On the top side, the flange 50 is supported by a set of reinforcing gussets 54. Bolt holes in the flange plates 50 and 52 are slotted to enable installation tolerances. The pile clamp 48 is split into two halves, the two halves being shown in FIG. 6. The halves are identical to one another and bolt together. They constitute a clamp mechanism for fastening around the piling 20. The clamp mechanism is thus formed of a first upstanding sleeve half 60 and a mating sleeve half 62. They are constructed with edge located flanges in the same fashion as shown in FIG. 3 and are pulled together and clamped by nuts and bolts. The two halves are thus pulled together and fastened snugly around the piling 20. Assume for purposes of discussion that the piling is 70 feet in length. Assume further that it is necessary to install the piling with about 52 feet protruding into the seabed. In that event, the piling is driven through the apparatus shown in FIG. 5 with the sleeve halves 60 and 62 loosely fastened or removed temporarily. After the piling has been driven to the predetermined penetration into the mud, the sleeve halves shown in FIG. 6 are fastened together and are pulled together to clamp around the piling. This typically is accomplished by first tightening the nuts and bolts indicated at 64. After that has been completed, the nuts and bolts at 66 are anchored to fix the sleeve snugly, firmly and tightly, around the piling. At this point, the pile clamp 48 may be welded to the pile around the top of the clamp if the installation is to be permanent or long term.

This apparatus is installed by moving it to the offshore location of the in-place conductor pipe. At the time of installation, it is installed by positioning separate halves adjacent to the conductor pipe 12, or by stabbing over the conductor pipe. Each half stands upright and is braced vertically by means of upstanding diagonal braces 70 and horizontal braces 16. Diagonal braces fasten at the upper ends to the top of the conductor clamp 30. They fasten at the lower ends to the respective corner located pile sleeves 18. The upstanding diagonal braces define a triangular construction as viewed from the side in FIG. 1 to produce a rigid structure. This rigid structure supports the conductor clamp in fixed relationship to the remainder of the structure so that the conductor pipe is not bent. Viewing FIG. 2, the two halves are thus installed so that they are located on opposite sides of the conductor pipe. The two halves are then bolted together at the conductor clamp 30 shown in FIG. 3. The nuts and bolts used to accomplish the fastening are tightened, but not snugly. The edge located frame members 24 and 28 are fastened tightly together, this occurring at two locations as shown in FIG. 2. This then assembles the structure around and adjacent to the conductor pipe. At this time, the pilings 20 are driven through the respective four corners. They are driven to a suitable depth to assure that the protective device 10 is anchored. The four corners are then made fast by tightening the bolts 64 and 66 shown in FIGS. 5 and 6. This anchors the four corners. The conductor clamp 30 is then bolted tightly along its length to pull snug around the conductor pipe. This completes installation of the anchor equipment, and secures the device snugly to the conductor pipe. At the time of removal, it is disassembled in the reverse sequence so that the two halves can be removed. The device is relatively small and lightweight in accordance with the normal scale of equipment installed at offshore drilling sites, and can easily be maneuvered by surface located cranes and underwater divers. The device can be installed and removed in relatively rapid order. After installation, the conductor pipe and hence the well for the pipe is reasonably secure against unintended damage. Moreover, this installation can be left at an offshore well location indefinitely to protect the well for a long period of time.

Recall that multiple wells are spaced closely and typically deviate below the mud level by known directional drilling techniques. At the mud line or bottom 14, the wells may have similar conductor pipes only a few feet apart. Noting the fact that the protection apparatus 10 divides along a central line, the two halves can be positioned adjacent to both conductor pipes, and the space between spanned by an E-shaped spacer. If desired, two conductor clamps can be installed on two wells.

While the foregoing is directed to the preferred embodiment, the scope is determined by the claims which follow.

What is claimed is:

1. A protective subsea apparatus to be installed on an offshore well having an upstanding conductor pipe extending above the sea bottom, the apparatus comprising:

(a) an upstanding conductor clamp adapted to encircle the conductor pipe, said conductor clamp formed by two upstanding facing members supported by a bottom engaging frame;

(b) said frame including a plurality of frame members joined together defining a substantially horizontal rectangular support frame for engaging the sea bottom;

(c) a plurality of angularly extending brace members secured at one end to said conductor clamp and at the other end to said frame; and (d) said conductor clamp being fixidly attached to said frame and extending upright thereabove to enable said clamp to fasten about the conductor pipe.

2. The apparatus of claim 1 wherein said clamp extends above said frame by a substantial length to substantially enclose the conductor pipe below sea level so that structural stresses induced by externally applied latteral loads are transferred to said frame and said brace members.

3. The apparatus of claim 2 wherein said conductor clamp comprises a pair of parallel semi-circular halves having adjacent flanges joining said halves to clamp and secure said halves as a single unit.

4. The apparatus of claim 3 wherein said frame is divided into two portions, said two portions releasably joining together, and one of said conductor clamp halves joined to each of said two portions of said frame.

5. The apparatus of claim 1 wherein said frame includes diagonally outwardly extending frame members connected at one end to said conductor clamp and at the other end to said frame.

6. The apparatus of claim 1 wherein said frame is a multisided, planar frame having a plurality of piling engaging sleeves joined thereto, and each of said sleeves is adapted to receive and engage a pile inserted therethrough and into the sea bottom.

7. The apparatus of claim 1 including a rectangular frame formed of four perpendicular frame members.

8. The apparatus of claim 1 wherein said frame comprises two separable frame units, and said conductor clamp is divided lengthwise into two portions to enable assembly around the well conductor pipe, one portion of said conductor clamp joined to each of said frame units.

9. The apparatus of claim 1 wherein:

(a) said conductor clamp is an elongate two part, split cylindrical shell;
(b) said conductor clamp includes means to fasten said shell parts to enclose the pipe;
(c) said frame includes radially extending frame members secured at one end to said conductor clamp;
(d) said frame includes frame members connected to said radially extending frame members to define a peripheral multisided frame support;
(e) at least two of said angularly extending brace members are connected to each of said conductor clamp parts;
(f) said brace members supporting said conductor clamp parts on enclosing the pipe;
(g) said frame being divided into two separable parts joined at releasable connections;
(h) said frame parts separately supporting said conductor clamp shell parts; and
(i) said frame including peripherally located means for anchoring to the sea bottom.

10. The apparatus of claim 9 wherein said anchoring means includes:

(a) an upright hollow sleeve connected to the frame;
(b) clamp means cooperative with said hollow sleeve;
(c) a piling to be inserted through said hollow sleeve into the sea bottom;
(d) said clamp means selectively gripping said piling; and
(e) lifting eyes on said piling enabling removal thereof when protection of the conductor pipe is no longer necessary.

11. The apparatus of claim 10 wherein four or more of said anchoring means are supported at four or more locations by said frame, said four or more locations defining a rectangle.

* * * * *